US005355823A

United States Patent [19]

Goldbach et al.

[11] Patent Number: 5,355,823

[45] **Date of Patent: * Oct. 18, 1994**

[54] APPARATUS AND METHOD FOR PERFORMING EXTERNAL SURFACE WORK ON SHIPS' HULLS

[75] Inventors: Richard A. Goldbach; William A. Wagner, both of Norfolk, Va.

[73] Assignee: MMC Compliance Engineering, Inc., Norfolk, Va.

[ * ] Notice: The portion of the term of this patent subsequent to May 18, 2010 has been disclaimed.

[21] Appl. No.: 975,520

[22] Filed: Nov. 12, 1992

Related U.S. Application Data

[63] Continuation-in-part of Ser. No. 782,315, Oct. 24, 1991, Pat. No. 5,211,125.

[51] Int. Cl.[5] ..... B63B 59/00

[52] U.S. Cl. ..... 114/222; 15/1.7

[58] Field of Search ..... 114/222; 15/53.1, 53.2, 15/53.3, 1.7

[56] References Cited

U.S. PATENT DOCUMENTS

| | | | |
|---|---|---|---|
| 783,276 | 2/1905 | Hughes . | |
| 821,776 | 5/1906 | Zoller . | |
| 3,149,438 | 9/1964 | Morley et al. | 51/8 |
| 4,232,487 | 11/1980 | Brown | 51/425 |
| 4,375,740 | 3/1983 | Brown | 51/425 |
| 4,395,850 | 8/1983 | Brown | 51/427 |
| 4,506,686 | 3/1985 | Bailard et al. | 114/222 |
| 4,549,835 | 10/1985 | Ando et al. | 114/222 |
| 4,658,749 | 4/1987 | Penalba | 111/222 |
| 4,782,844 | 11/1988 | Hughes | 114/222 |
| 4,784,078 | 11/1988 | Feurt | 114/222 |
| 4,825,598 | 5/1989 | Schlick | 51/410 |
| 4,890,567 | 1/1990 | Caduff | 114/222 |
| 5,007,210 | 4/1991 | Urakami | 114/222 |
| 5,038,527 | 8/1991 | Fastje | 51/426 |
| 5,138,963 | 8/1992 | Eichert | 114/222 |
| 5,211,125 | 5/1993 | Garland et al. | 114/222 |

OTHER PUBLICATIONS

Aerial photograph of ship repair facility of Metro Machine Corporation, Norfolk, Virginia.

EPA report regarding cleaning and painting of ships' hulls.

National Shipbuilding Research Program, U.S. Department of the Navy, David Taylor Research Center in cooperation with National Steel and Shipbuilding Company, *Staging Systems for Ships During New Construction and Repair,* Jun. 1992.

*Primary Examiner*—David M. Mitchell
*Assistant Examiner*—Stephen P. Avila
*Attorney, Agent, or Firm*—Cushman Darby & Cushman

[57] ABSTRACT

For coating the exterior of a ship hull while the ship is in drydock or afloat, creating a sizable chamber with comprehensive staging access for all required work, sealing off that chamber to contain environmentally unacceptable byproducts of the coating process, to keep storm water runoff from passing through spent abrasive and paint overspray on the deck of the drydock or barge and to keep out weather conditions which could delay and deteriorate the quality of this coating process, ventilating and evacuating the chamber maintaining an atmosphere inside the chamber which is conducive to worker safety and high coating quality and maintaining an atmosphere outside the chamber which is conducive to meeting requirements for the clean air and clean water laws and regulations, and at the same time reducing the overall cost of coating.

33 Claims, 14 Drawing Sheets

APPARATUS AND METHOD FOR PERFORMING EXTERNAL SURFACE WORK ON SHIPS' HULLS

REFERENCE TO RELATED APPLICATION

This is a continuation in part of application Ser. No. 07/782,315, filed Oct. 24, 1991 now U.S. Pat. No. 5,211,125.

BACKGROUND OF THE INVENTION

In the co-pending application of Garland et al., application Ser. No. 07/782,315, now U.S. Pat. No. 5,211,125, there is disclosed apparatus and a method for performing external surface work on ships hulls in compliance with environmental and safety regulations as they have or may in the future become more restrictive.

The present invention relates to improvements in the method and apparatus disclosed in the above-identified, earlier application, the contents of which are incorporated here in by reference.

In general, the invention relates to providing an atmospherically controlled sealed enclosure which permits economical staging access to and coating of exposed areas of ships' hulls of varying configurations both afloat and in drydock during the abrasive blasting, spray painting and solvent evaporation phases of the coating process so as to be, so far as practically possible, in full compliance with requirements of the U.S. Clean Air Act and Clean Water Act.

Ship's hulls are very large and are complexly contoured in both the vertical and longitudinal directions. The world's population of ships has a very significant number of different sizes and shapes.

Coating of the exteriors of ships requires using abrasive blasters for surface preparation and painters for application of paint. Both blasters and painters must be brought into close proximity to the portion of the hull they are working. Neither blasters nor painters can perform their work on much more than 75 square feet of hull surface without moving or being moved to another location.

In earlier times, worker movement from place to place around a ship's hull was accommodated by building staging around the ship.

Also, in earlier times, the coating of the exterior hull above the waterline was most often done with the ship afloat. However, enactment in the U.S. of the clean water acts all but eliminated this practice since coating of this area of a ship afloat deposited significantly more spent abrasive and paint overspray in the water than did coating in a drydock.

More recently, this movement has been accomplished through the use of manlifts. A conventional manlift includes a staging basket mounted on an arm which has the capability of being hydraulically lifted, extended and rotated; this arm being mounted on a carriage powered by an internal combustion engine. The carriage has the capability of being moved from place to place on a horizontal surface.

Even more recently for abrasive blasting, efforts have been made to replace the worker in the manlift basket, with an enclosed shotblast head which has the capability of catching, processing and reusing the abrasive. However, this approach has had little acceptance because of the cost to purchase and operate the apparatus, plus operating difficulties with the devices actually available.

Since ships are very large vessels which operate on large bodies of water, their construction and repair including dry-docking almost always takes place immediately adjacent to large bodies of water.

Pollution of these large bodies of water including Great Lakes, rivers, seas, bays and oceans has become of much greater concern to societies around the world because of the negative effect of this pollution on the vegetable and animal life which depend upon these bodies of water. This concern has grown as more of the public elects to use these bodies of water for recreation through swimming and boating as well as living adjacent to them in hotels, houses, apartments and condominiums.

Abrasive blasting of a ship's hull necessarily creates a significant quantity of particulate material, usually dust comprised in part of smaller particles of the abrasive medium as it breaks down upon being propelled pneumatically against the ship's hull and in part of small particles of the ship's paint and steel which is removed by the abrasive. While this dust is not currently officially considered to be hazardous, it is nevertheless noxious to the public and does contain toxins in apparently nonhazardous quantities.

Because a portion of this dust inevitably is blown over the adjacent body of water, small quantities of these toxins find their way into the water. Further, if the large percentage of the spent abrasive which lands on the drydock floor is not promptly cleaned up, trace amounts of the toxins leach out during rainstorms or from other sources of water used in ship repair and are deposited into the body of water from the drydock's drainage system. Toxic petroleum products including fuels, lubricants and greases associated with manlift operations can similarly be carried through the drydock drainage system into the adjacent body of water.

Recent regulations implementing the U.S. Clean Water Act impose more stringent restrictions on contaminants in storm water runoff. These regulations mandate that either contaminants be eliminated or storm water runoff be collected and treated, a process not currently feasible because of the quantity of water involved.

Typically, a ship has a large quantity of exterior mechanical equipment. This equipment, which is expensive to repair and purchase, is subject to severe damage if infiltrated by the dust from abrasive blasting, which is itself very abrasive. This mechanical equipment, which includes interior ventilation systems, must be temporarily covered with protective covering during abrasive blasting. This temporary covering prevents the interior ventilation systems from being operated or repaired when abrasive blasting is underway.

Virtually all the equipment required for abrasive blasting has mechanical components. This includes air compressors, manlifts, forklifts, dust collectors and drydock cranes. Since this equipment must operate during abrasive blasting, it cannot be protected. It therefore experiences very high maintenance cost, extensive out-of-service periods, and shortened operating life.

Coatings on drydock horizontal surfaces experience short lives as they are abraded off by the combination of spent abrasive and vehicular and personnel movement, including that which accompanies shoveling and sweeping.

Workers who are free to proceed with exterior ship construction and/or repair tasks which do not involve mechanical ship's components are disrupted, made less efficient and exposed to respiratory and eye aggravation when abrasive blasting is proceeding concurrently. Workers and ship's personnel transiting through the abrasive dust cloud to and from the interior of the ship are similarly affected.

Most ships operate in a corrosive saltwater/ spray environment. Therefore, the most popular marine paints are solvent-based vinyls and epoxies. Some marine paints contain zinc or copper. During the time that these paints are being applied, overspray is often blown into the adjacent body of water. This same overspray can coat itself on nearby boats, buildings, waterside cafes and cars, causing expensive damage and infuriating the public. Even the portion of the overspray which lands on the drydock floor can find its way back into the adjacent body of water as it attaches itself to dust or dirt particles on the floor of the drydock which are washed by water through the drydock's drainage system.

Non-water-based paint solvents common in marine coatings release volatile organic compounds (VOCs) into the atmosphere during the time that they are evaporating, during the paint curing process. Regulatory authorities are becoming increasingly concerned that these VOCs are damaging the environment. While VOC emissions from marine paints may not be apparent to the public, they are a matter of growing regulatory oversight, and likely will ultimately have to be reduced. The only current way to dispose of these invisible VOCs is to contain the air into which they are released, and then process that air through a VOC incinerator.

Best management practices being currently utilized to minimize the amount of abrasive dust and paint overspray being blown beyond the drydock perimeter include placing a curtain over each end of the drydock, performing abrasive blasting downward only, using airless paint spray equipment, and ceasing operations when wind velocities become higher than a predetermined limit. However, these practices nevertheless permit a significant percentage of the airborne abrasive dust and paint overspray to blow outside of the perimeter of the drydock. In addition, these practices do nothing to reduce the many other negative affects of the ship coating process.

Recently, some shipyards have begun shrouding ships, from the weather deck down to the drydock structure, with very large strips of material. This material must be somewhat porous to keep it from shredding in the wind. However, the lives of these large strips of material are short because of damage from wind, handling, errant abrasive blasting and other hazards inherent to the heavy industrial environment prevalent in shipyards. Because of the basic cost of the shrouding material itself, its short life in the shipyard environment, the cost of installing, removing, handling and storing it, this approach is very expensive. While this approach contains even more airborne abrasive dust and paint overspray within the drydock perimeter than currently accepted best management practices, some still escapes through the necessarily porous material and through the joints where the strips of material overlap. In addition, this approach does little to solve the many other negative effects of the ship coating process.

One other technology exists that reduces dust from sandblasting, that is the technology of vacuum blasting. However, this process is very slow and very costly, from an equipment and manpower standpoint.

With regard to approaches to resolving the many problems associated with the coating of ships, as expensive as the coating process is or may become, the major cost consideration is the speed with which a ship may be coated or recoated. This is because of the daily amortization and operation costs of the drydock required to lift the ship out of the water for recoating ($5,000 to $20,000 U.S. per day) and the ship itself which is out of service during recoating ($10,000 to $100,000 U.S. per day). These costs demand that with whatever solutions are developed to solve the existing problems with abrasive blasting and coating of ships, elapsed time of the coating process be of the essence.

SUMMARY OF THE INVENTION

Apparatus and a method are provided for enclosing external surface work, including cleaning and/or painting, which largely overcomes the above described shortcomings in the apparatus and methods that heretofore have been proposed or made available.

In practicing the invention, the enclosed ship staging described in the co-pending U.S. patent application of Garland et al. application Ser. No. 07/782,315 device preferably is provided and used albeit preferably with some modifications; such a device has sufficient freedom of motion to permit full worker access to a ship's hull and also has the capability of containing abrasive blast dust, spent abrasive, paint overspray and volatile organic compounds (VOCs), thereby significantly reducing the quantities of these materials which are released to contaminate the air, nearby bodies of water, ship's mechanical equipment, drydock cranes, abrasive blasting and painting support mechanical equipment, local housing, automobiles, nearby yachts and other floating vessels, and thus significantly reducing the efforts necessary to collect, dispose of, recycle and incinerate waste abrasive and paint residue and significantly reducing the disruption of other concurrent shipboard repair work, all without increasing the dry-dock utilization times or ship out-of-service times.

For cleaning and/or painting the exterior of a ship hull while the ship is in drydock, one or more staging devices are provided. Each includes a metal framework tower supporting a vertically movable elevator assembly that comprises a trolley, from which a variably laterally projecting platform is supported on articulated, cantilevered arms.

When multiple staging devices are utilized, they are placed on the floor of a floating drydock or on a barge deck adjacent to each other to form a single large enclosure. Horizontal and vertical mating enclosure surfaces between individual enclosed ship staging devices are sealed by an inflatable seal or other seal, mounted on one end of each individual enclosed ship staging device. Outside ends of enclosed ship staging devices placed at the extreme end of the single large enclosure are equipped with adjustable non-porous shrouds held against the hull by rope or magnets which attach to the ship's hull to seal ends of the single large enclosure. In extreme bow and stern areas where the combined vertical and horizontal shape variation is too severe to be served by a (typically) maximum ten foot (three meter) extension of the (typically) twenty foot (6.1 m) staging platform of an individual enclosed staging device, an enclosure without a staging device but compatible with the enclosure of the enclosed ship staging device is installed. Access to the hull for abrasive blasting and painting in this area of severe shape variation is achieved using traditional staging means.

Portable dams or storm water gutter bars with magnets or other means of temporary attachment to the deck of the drydock or coating barge are then placed around the perimeter of the overall enclosure and sealed by grouting, gasketing or other means.

Ventilation, heating, dehumidification, abrasive dust collection, paint overspray filtration and solvent evaporation VOC incineration equipment are then hooked up to the single large enclosure, consistent with the requirements for worker safety, environmental protection and coating application. The number of individual enclosed ship-staging devices used to form a single large enclosed area will be dictated by evaluation of economic factors including but not limited to facility cost, drydock time utilized, ship schedules, available workers, available electric power, etc.

For cleaning and/or painting the exterior of a ship afloat, the individual enclosures with and without staging devices instead of being similarly placed on the floor of a floating drydock, preferably are placed on the deck of a floating barge.

The barge is then attached to the side of a ship, outboard of a pier, in successive locations, as coating of the full side shell above the waterline is accomplished. The deck edge of the barge adjacent to the ship and the top edge of the combined enclosures adjacent to the ship are equipped with inflatable seals or other seals, which close off the bottom and top of the large overall enclosure as coating is accomplished.

The ability to coat the portion of a ship's hull above the waterline while the ship is afloat considerably reduces drydock time and cost, the largest element of ship's hull coating cost.

In a preferred practice, a support barge which contains equipment that would otherwise be located on the floor of the drydock, including that for ventilation, heating, dehumidification, abrasive dust collection, paint overspray filtration, and solvent evaporation VOC incineration, is moored to the side of the enclosure barge which is outboard of that attached to the ship. The support barge is also equipped with electrical generating equipment, air compressors, fuel tanks and other equipment necessary to support the coating process.

During coating of a ship's hull while in drydock, depending on the water access at the ends of the drydock, ventilation units, heating units, dehumidification units, abrasive dust collection units, paint overspray filtration units and solvent evaporation VOC incineration units that would otherwise be placed temporarily on the drydock floor can be installed permanently aboard a support barge with electrical power generating equipment and fuel storage with the support barge moored to either end of the drydock, as appropriate.

Providing comprehensive compliant atmospheric control to enclosures attached to ships afloat and in drydock in this manner will considerably reduce the cost of manpower and materials required to handle, setup and hook up this equipment, together with drydock time lost during the process.

Compared with the apparatus and method disclosed in the above-mentioned, earlier patent application of Garland et al., the present invention:

a. Provides for using a plurality of enclosed staging devices joined together to form a single large enclosed area. This area can be served by common units for ventilation, heating, dehumidification, abrasive dust collection, paint overspray filtration and solvent evaporation volatile organic compound (VOC) incineration.

b. Provides for enclosures without staging devices, for use in extreme ship bow and stern areas with extensive shape variations best served by existing manlift devices or other traditional staging. These enclosures are compatible with the enclosed staging devices and can be joined with them to enclose a single space comprised both of areas best served by the enclosed staging device and bow and stern areas with extensive shape variations best served by traditional staging. This combined area can be served by common units for ventilation, heating, dehumidification, abrasive dust collection, paint overspray filtration and solvent evaporation VOC incineration.

c. Provides for using a plurality of enclosed staging devices joined together on a floating barge to form a single large enclosed area which can be attached to a ship afloat in the water to permit economical recoating of ship exterior hull areas above the waterline without the need for drydocking.

d. Provides for preventing storm water from passing through spent abrasive and paint overspray as it runs off the deck of a drydock or coating barge into a body of water.

e. Provides for an enclosure support barge to provide ventilation, heating, dehumidification, abrasive dust collection, paint overspray filtration and solvent evaporation VOC incineration which can provide compliant atmospheric control to coating enclosures attached to ships afloat and in drydock.

f. Provides an improved control system for actuating the work platform of the staging device of referenced co-pending application.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings:

FIGS. 1–8 and the related description have been carried forward (with modifications to FIGS. 2, 3 and 8 from the above-identified copending U.S. patent application Ser. No. 07/782,315, now U.S. Pat. No. 5,211,125).

The coating operation which is shown and described is sometimes herein referred to by a term "CAPE".

DETAILED DESCRIPTION

Figure 1:
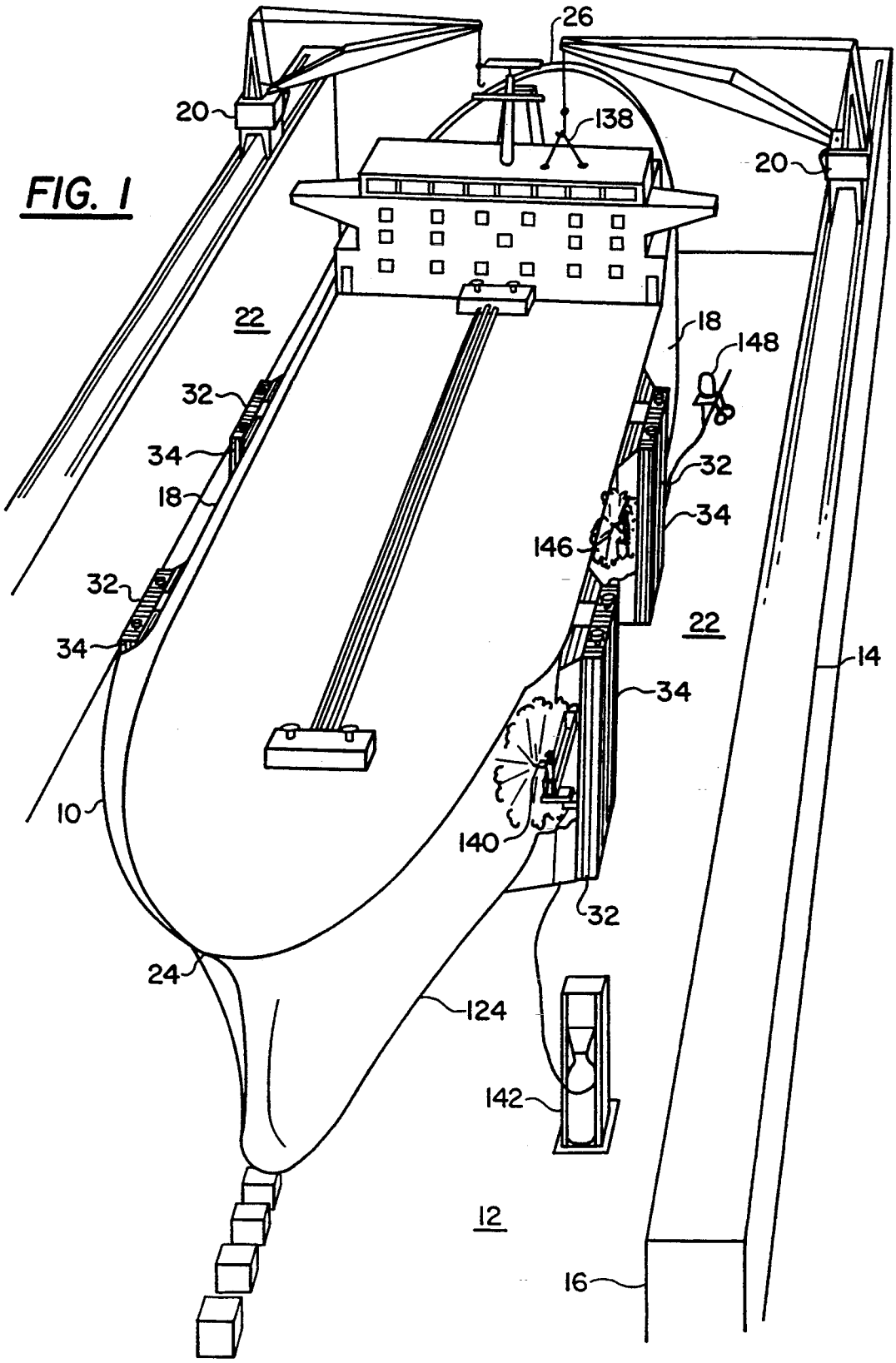
FIG. 1 is a pictorial view, from above, of a ship in drydock, showing four ship staging devices provided in accordance with principles of the invention, being used for conducting enclosed cleaning and painting operations on a respective four increments, on two sides, of the exterior of the ship hull, the shroud on the device in the foreground being shown partly broken away so as to show the operation in progress. The dry-dock crane which can be used for moving the devices to address successive increments of the hull should be noted.
Figure 2:
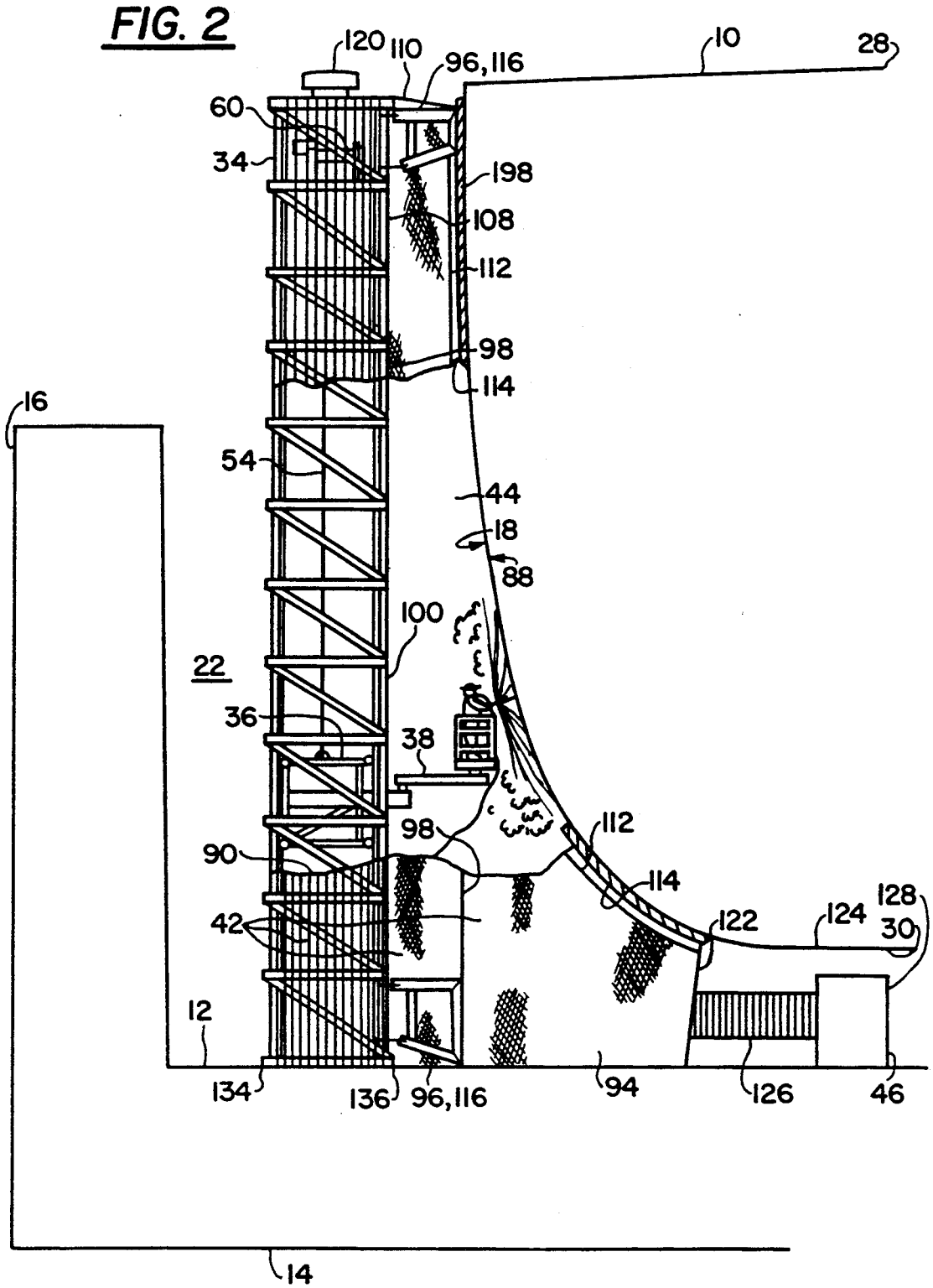
FIG. 2 is a side elevation view of one of the ship staging devices of FIG. 1, on a larger scale.

A typical ship is shown at 10 in FIGS. 1 and 2, supported on the pontoon deck 12 of a dry dock 14 which has upstanding wingwalls 16 that spacedly flank the two opposite sides 18 of the exterior of the hull of the ship. The dry dock 14 typically includes a conventional crane 20, which is typically used for moving parts and supplies to and from the ship, and for shifting the locations of apparatus which are used for performing various fitting and repair functions in relation to the ship. The crane 20 therefore is capable of placing and shifting apparatus at any selected location (e.g., in the alleys 22 between the wingwall and hull) on each side of the ship, between the ship bow 24 and ship stern 26.

A conventional ship hull has its maximum width dimension from the fore and aft centerline of the ship, at its weather deck that is usually located approximately midway along the length of the ship (midships). At any given location along the length of a ship, the distance of the hull from the fore and aft centerline tends to progressively reduce in the downward direction, between the weather deck height 28 and the keel height 30. Forward and aft of midships, the distance of the hull from the longitudinal centerline at any selected vertical height tends to further reduce progressively, until the minimum dimension is reached at keel height at the bow and stern (normally zero). Along given twenty-foot length (longitudinal) increments, most hulls have compound curvature in which the width dimension of the hull from the fore and aft centerline at greater distances below the weather deck reduces more radically at locations further from midships.

The present invention provides one or more enclosed staging devices 32 which can be used for enclosing coating work on the exterior of the ship hull while the ship is in dry dock or afloat. Typically, the ship is a used ship that has come in for maintenance, repairs, and/or refitting. Thus, there may be other work needing to be done, relatively simultaneously, to interior, deck and superstructure parts of the ship, as the apparatus and method of the present invention are being used in connection with work being done on the outside of the ship hull. Typically, the coating work to be done on the outside of the ship hull principally includes abrading-away of debris, corrosion, marine encrustations, scale, old coatings, and applying new coatings, typically by spraying. (In this document, such coatings are generically sometimes referred to as being "painted", without regard to whether a coatings specialist might use that term more restrictively.) Whether one or a plurality of the devices 32 are used will depend on the size of the ship, how quickly the work must be done, and the size of the workforce. Whether one size or two or more differently sized devices 32 are used, may depend on how radically the sides of the hull slope inwardly at various sites along the hull. (That is, in some instances, it may be more advantageous to reach certain areas using a smaller, supplemental device, or a different technique, such as vacuum blasting, than to construct the device 32 so as to be able to cantilever its platform to an extremely extended disposition.)

In very general terms, each enclosed staging device 32 includes a vertical tower 34 which is shiftably supported in an alley 22 on the deck of the drydock, a trolley 35 which can be raised and lowered in the tower and stationed at a selected height, a set of cantilevered areas 38 mounted to the trolley so that their forward ends, on which a work platform 40 is mounted, can extend towards and retract away from the ship hull, a shroud assembly 42 which substantially completely encloses a volume of space 44 that is confronted by a vertical segment or increment of the ship hull from weather deck to keel (and which typically is twenty feet horizontally long, longitudinally of the ship), an air movement control system 46 for controlled ventilation of the enclosed space; and power system 48, for operating the trolley, extending and retracting the work platform, and adjusting the forward margin of the shroud to keep it close to the hull along the leading and trailing vertical edges of the particular hull segment being worked on.

Of course, despite the fact that the device 32 has been developed to facilitate the conducting of surface preparation abrading the spray painting operations, additional, or other operations could be conducted within the space 44, using the device 32 as a protective enclosure.

By preference, the tower 34, is a portable framework of struts, ties, braces, connectors and other elements which can be removably secured together so as to provide a unit of the required height to permit access to the whole of the height of a given ship's side, from the height of the weather deck, down to the keel or waterline. Of course, in the instance of a yard which anticipates only working on one size of hull for the whole of the working life of a device 32, the tower could be permanently secured together, e.g., by flame cutting of plates, extrusion of long members, welding of joints, etc. In general, the tower 34 may be made of steel or aluminum, and in substantially the same way and of the same elements and materials, as are conventionally used in the manufacture of elevators used at building construction and retrofitting sites for conveying workers and/or materials to various floors of the building.

A cage, car or elevating trolley 36 is mounted to the tower 34 (e.g., by opposed sets of flanged wheels 50 which roll on vertical tracks 52 provided by respective elements of the tower 34).

The trolley is suspended in the tower 34 for elevation, by cables 54 which connect to the trolley at 56 and to the drum of a hydraulic winch 60. The connection mechanism 56 each are provided in the form of a spring-loaded ratchet lever 62 which seats in a respective notch 64 in a vertical rail 66 of the tower 34, unless and only for so long as there is lifting tension drawn on the lifting cables 54. Where safety regulations provide otherwise, the trolley may be suspended in the tower using counterweighted cables, other braking or locking systems, redundant cabling, and/or similar conventional means for preventing the trolley from suddenly or unexpectedly dropping due to mechanical or power failures.

It should now be noticed that, whereas various ties and braces preferably are provided around the rear and sides of the tower, the tower front, which, in use, faces the ship side, is substantially open and unobstructed at 68, from the level of the ship's weather deck, down to the keel (i.e., over the full height of the increment of the ship that will need to be worked on using the device 32).

Both of the rear internal corners of the trolley 36 are provided with respective vertical axles 70 on which are journalled for rotating the rear ends of respective cantilevered arms 38. By preference, each arm 38 comprises a rear section 72, hinged at its forward end to a forward section 74, hinged at its forward end to a forward section 74 by a vertical axle 76, and each forward section 74, at its forward end is provided with a vertical axle 78. A work platform 40 is mounted to the forward ends of the arms 38, by the axles 78. Accordingly, the arms 38 are articulated by the joints 70, 76 and 78 between the trolley and the work platform, so that they can extend and retract the work platform horizontally (transversally, laterally) relative to the vertical axis of the tower, for moving the work platform towards and away from the longitudinal centerline of the hull. In use, the work platform, as a result, can be retracted as the elevator is raised or lowered, in order to avoid bumping into the hull, and may be extended further as the trolley is lowered, so that the workers riding on the work platform can maintain their close proximity with the exterior of the hull, despite the fact that the width of the hull decreases with height throughout at least a part of the height of the ship.

Of course, the arms could be operated manually or, more elaborate means could be provided for coordinating extension and retraction of the cylinders.

The work platform is retracted by coordinately retracting the piston-cylinder arrangements 80 and 84, and extended by coordinately extending the piston and cylinder arrangements 80 and 84.

The work platform may be configured as necessary (e.g., as to whether it has seats, handholds, rails). At its most basic, it includes a support 40 capable of supporting at least one, and preferably two side-by side human workers. A typical work platform is on the order of sixteen feet (4.9 m) wide (lengthwise of the ship), and two feet (0.6 m) deep (widthwise of the ship). Similar support for a robotics device instead of or in addition to one or more human workers is within the contemplation of the invention.

The shroud assembly 42 may be comprised of several components, all of which cooperate to define (together with a respective increment 88 of the exterior of a side 18 of the hull, typically from weather deck to keel and about twenty feet (6.1 m) long, longitudinally of the hull), an enclosed space 44 within which work on the increment of the exterior of the hull can be conducted.

Thus, one necessary component of the shroud assembly 42 is one for confining the rear side of the space. This component may conveniently be provided by securing panels of clear corrugated fiberglass-reinforced plastic siding 90 to the outsides of the rear, fore side, aft side and top of the tower. In use, the fiberglass-reinforced plastic panels 90 may have shorter lives than the tower, and be subject to localized replacement as they wear through or otherwise become too worn.

Figure 3:
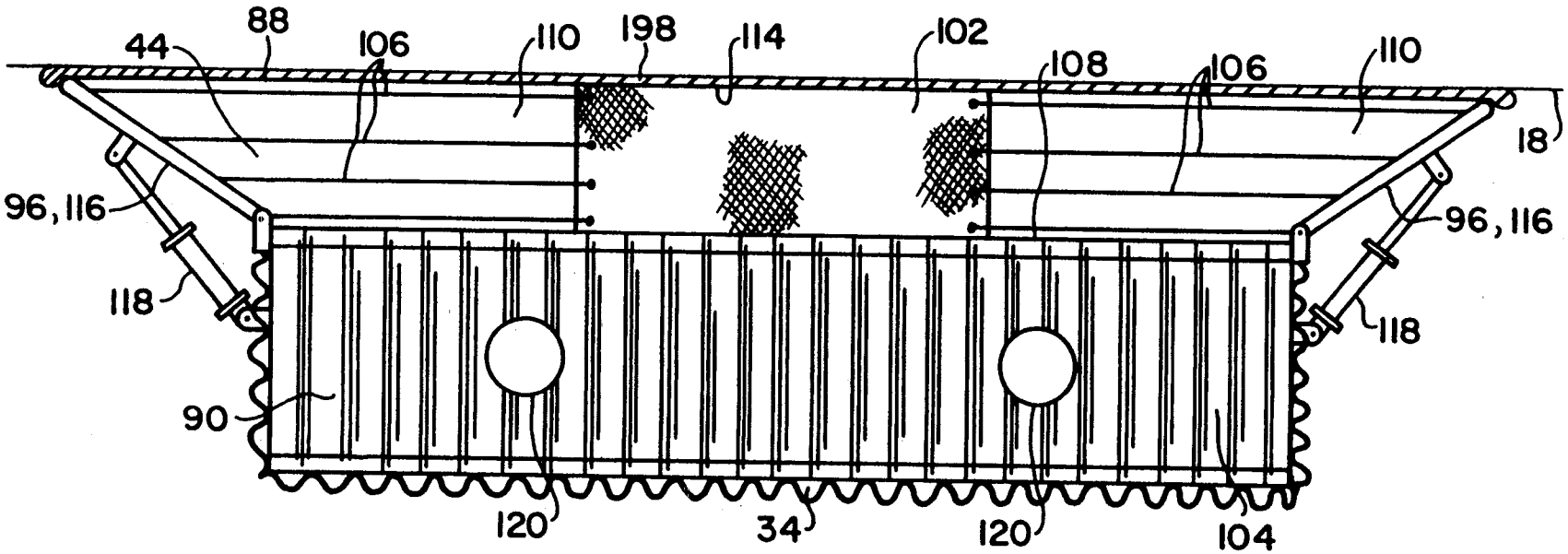
FIG. 3 is a top plan view of the tower and shroud structure thereof.
Figure 4:
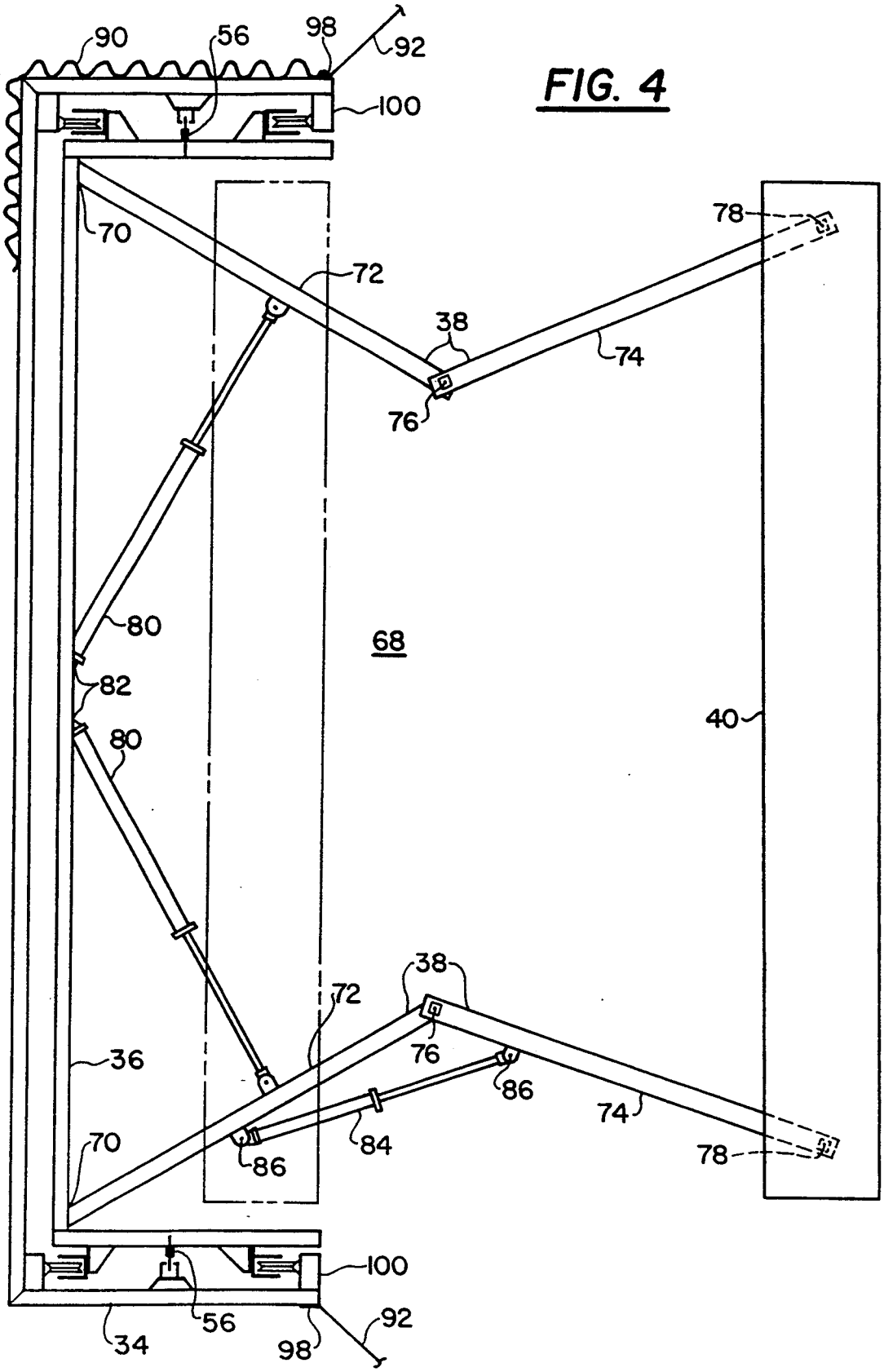
FIG. 4 is a downward-looking transverse sectional view thereof, taken at a level below the hoist but above the trolley, showing the cantilevered truss arms supporting the work platform at a variably transversally extended position relative to the tower.
Figure 5:
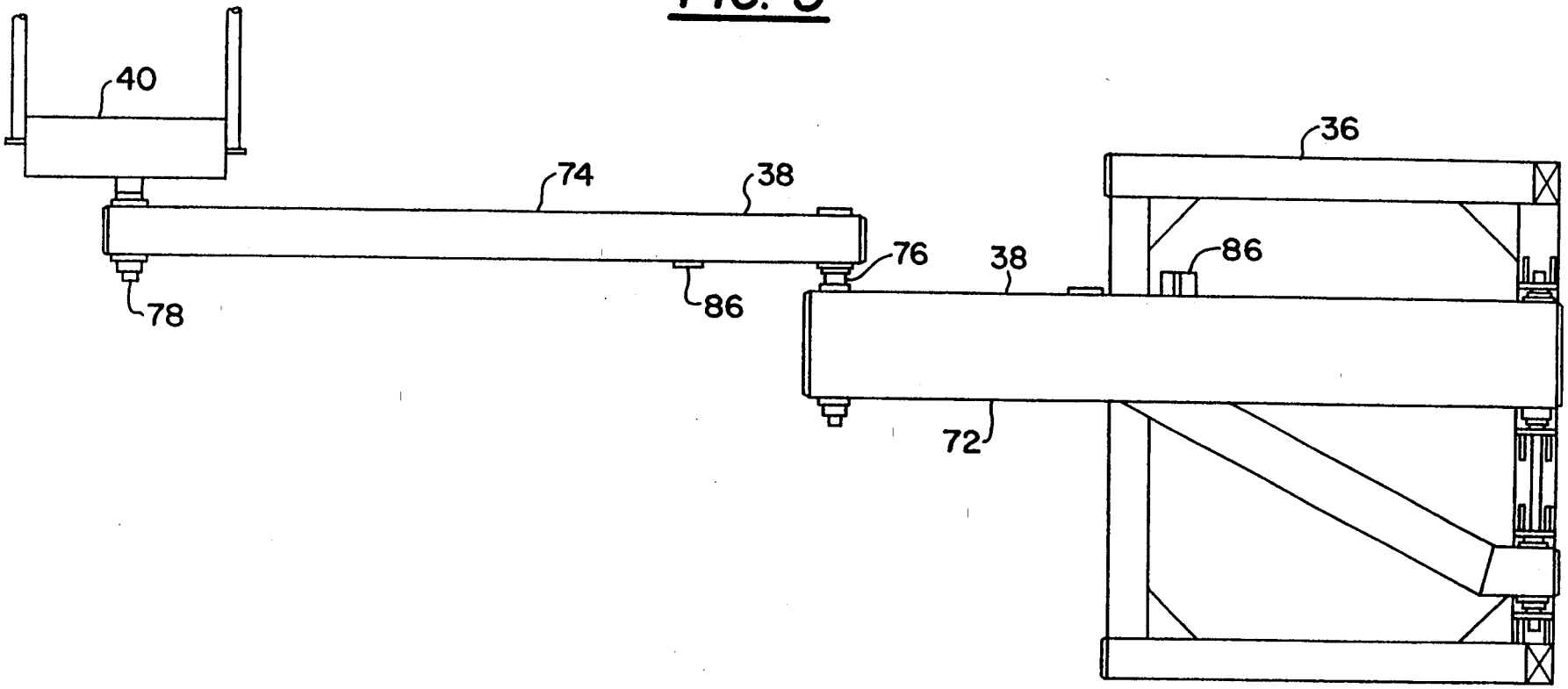
FIG. 5 is a side elevational view of the structure shown in FIG. 4, with the trolley in longitudinal section.
Figure 6:
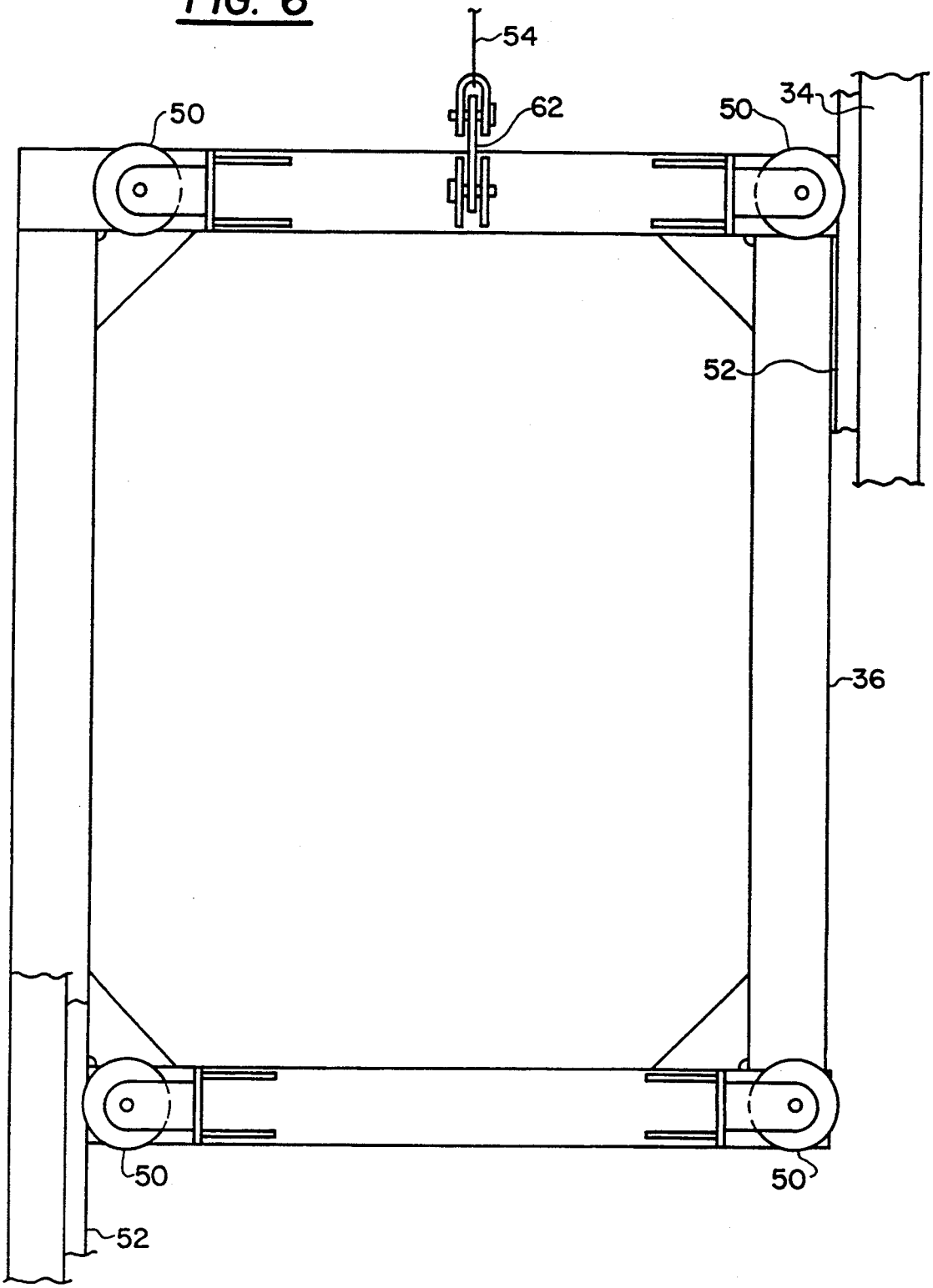
FIG. 6 is a side elevation view of the trolley, with the arms omitted, showing the relation of the trolley to the frame.
Figure 7:
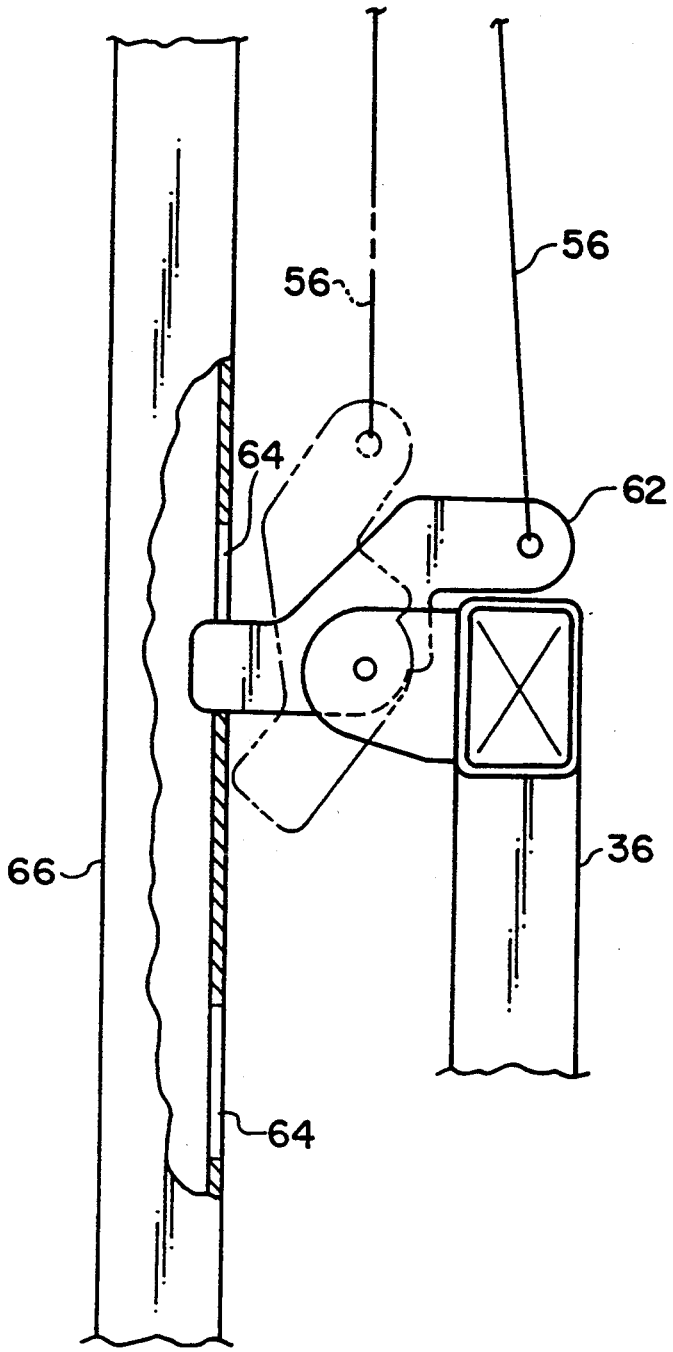
FIG. 7 is a fragmentary elevational view, with some parts cut away and sectioned, showing one of the preferred safety ratchet assemblies for each of the two lift points for the trolley.

The other major components of the shroud assembly 42 are side curtain assemblies 92. Each side curtain assembly 92 includes a respective curtain 94, which may be made of canvas, and spreaders 96 provided as vertical axis forward, extensions of the tower at the top and base of the tower; these usually respectively project obliquely towards fore and aft (as best seen in FIG. 3), so that the space 44 broadens from the tower towards the hull. An alternative such as Herculite flexible sheeting material may be used in place of standard marine quality canvas. Each curtain 94 may be made of one piece, or of several pieces laced, shock corded grommeted, Velcro fastened or otherwise secured to one another. Similar securement means (lacing, shock cords, Velcro tabs, etc.) are used at 98 to removably secure the rear edge 108 of each curtain to the respective spreaders 96, and to the front legs 100 of the tower 34, from tower base to tower top, and across in front of the tower top to provide a continuation at 102 of the top wall 104 of the tower 34. In fact, in FIG. 3, the two side curtains are shown somewhat overlapped at the middle of the top 102, with the ends 110 shock corded at 106 to the respective upper spreaders 96.

The front margins 112 of the curtains 94 are preferably provided with a series of electromagnets or permanent magnets 114 sewn or otherwise secured to them (much as is conventionally done to the lower hem of a conventional bath tub shower curtain liner) for permitting the front edges of the curtains 94 to be adjustably held close against the vessel hull at the longitudinal extremes of the hull segment being enclosed by the device 32. The strength and placement of the magnets will need to depend on the weight of the curtain, and the winds locally expected to be encountered which the ship is being worked on. The virtue of electromagnets is that they can be turned off to disconnect them when the device 32 is to be moved.

The curtains 94 may be provided so as to be adjusted entirely manually, or, by preference, manual adjustment may be supplemented by one or more hydraulically actuated batwing skeleton-like structures 116 secured to the respective curtains 94, and mounted at rear edges to the front legs 100 of the tower. The hydraulic piston-cylinder assemblies 118 of these structures 116 are extended to extend the curtains forwardly, and retracted so as to buckle the structures 116 and, thus, retract or facilitate retraction of the curtains. By preference, the structures 116 are somewhat flexible, and mechanically latch in an extended condition (much as does the metal framework of an umbrella), so that hydraulic pressure is not necessarily relied-upon to maintain the structures 116 in their extended condition.

Figure 8:
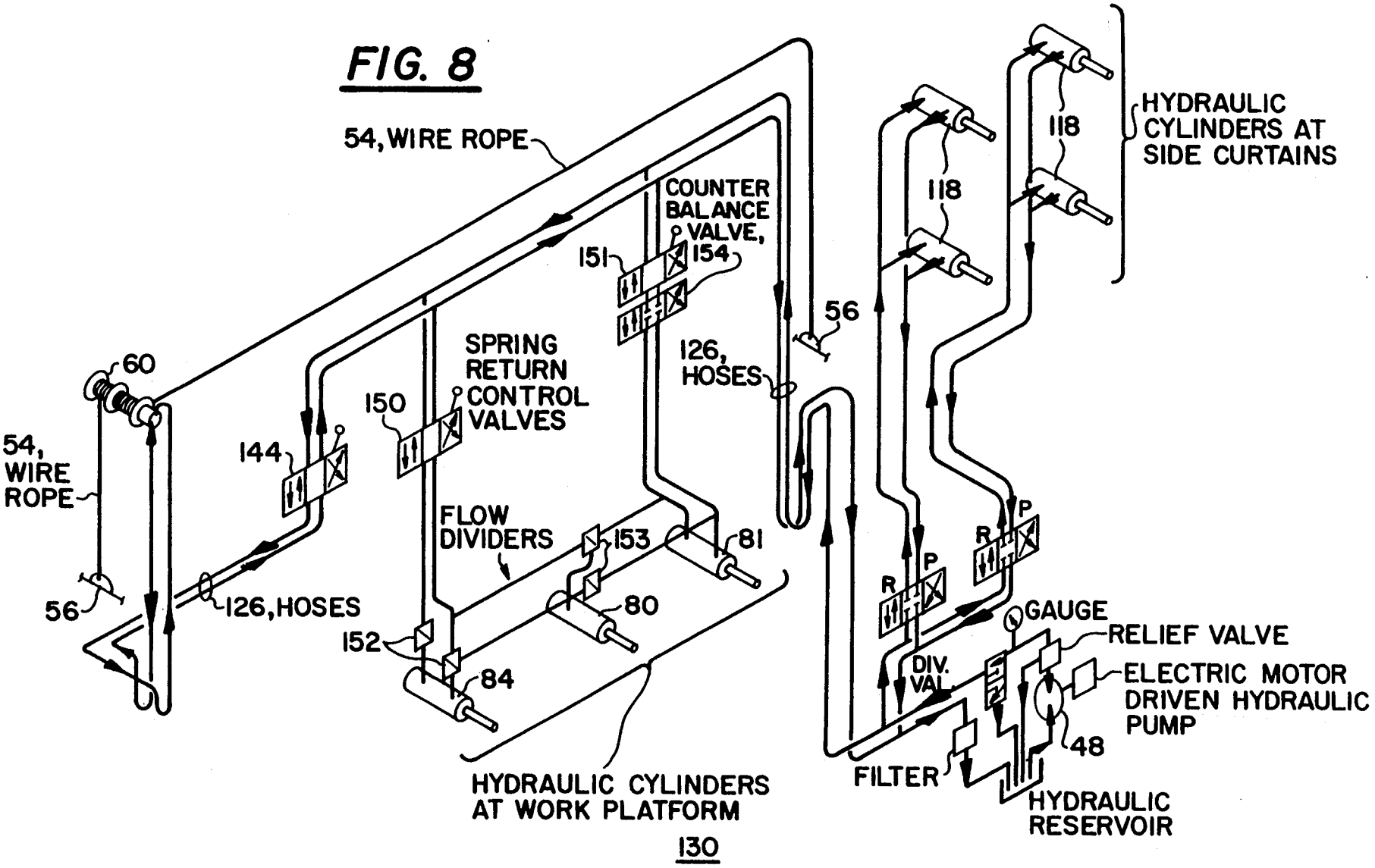
FIG. 8 is a schematic diagram of the hydraulic power system for the device.

A typical electrohydraulic system for operating the hoist, extension and retraction of the work platform, and the curtain-spreading skeletal structure 116 is illustrated at 130 in FIG. 8.

The present invention provides improvements for controlling the movement of the work platform using control valves and flow dividers relative to the apparatus and method disclosed in the co-pending U.S. patent application of Garland et al., Application Ser. No. 07/782,315.

Manually operating control valve 150 allows fluid to flow through flow divider 152 where eight units of flow are divided, allowing two units to travel to cylinder 84 and six units to flow to flow divider 153. The six units are divided into two equal flows of three units each which travel to cylinders 80 and 81. Since cylinder 84 has a travel of two feet (61 cm), cylinders 80 and 81 have travels of three feet (91 cm) and each cylinder has the same bore, the cylinders will each make their full travel at the same time. This will cause the platform 40 to remain parallel to the carriage 36 at all times. The counterbalance valve 154 blocks control valve 151 so that flow cannot travel back into valve 151. The same arrangement works to return the platform 40 to the parked position.

After the platform 40 is extended the angle of the platform 40 can be changed by releasing control valve 150 and actuating control valve 151 allowing fluid to travel through the counterbalance valve 154 to cylinder 80 and moving one end of the platform 40. The opposite end will always remain fixed and in the same plane.

Benefits of this improved apparatus and method are that it is simpler and safer to operate, its use requires less training and the platform will always remain within the lateral confines of the shroud.

The final major component of the device 32 to be described is the air movement control system 46. At its simplest, this system is shown including a set of dome-lidded air inlet vents 120 provided in the top 104 of the tower (through the shroud assembly 42, into the enclosed space 44), and through a lower lip area 122 (where the two shroud curtains 94 overlap and are overlapped and secured together, e.g., by shock cords, to close the space 44 between the bottom 124 of the ship hull at the base of the side 18) out of the enclosed space 44 by a flexible hose 126 leading into the suction side of a forced air dust collector 128 (which may be visualized as being an industrial-strength vacuum cleaner, of conventional construction. Actually, it may include a bag house, cyclone separator, grit/paint separation facility (for grit reclamation, if feasible), a scrubber and/or a burner for incinerating VOCs.

The bottom four corners of the tower 34 are preferably provided with height adjustable leveling jacks 134, with foot pads 136 which rest on the pontoon deck 12 of the drydock 14, and the top of the tower 34 is provided with a sling 138, e.g., made of wire rope, which can be hooked by the crane 20 for lifting the device 32 and moving it longitudinally fore or aft to a succeeding increment of hull.

The typical full extent of the path of extension-retraction of the work platform relative to the trolley is ten feet (3 m).

The tower 34 preferably is fabricated in modules of framework, such that for each job, the tower can be shortened or heightened, as necessary, typically in ten foot (3.0 m) segments.

In a typical use of the device 32, it is set up relative to a ship hull increment as shown in FIGS. 1–3. Then, two abrasive-blasting workers enter the enclosed space 44 with their abrasive blasting hoses and nozzles 140, which are connected to externally sited conventional abrasive-blasting supply machines 142.

The abrasive blasters raise the trolley 36, and thus, the platform 40 to its uppermost position using the work platform controls 144 and begin the abrasive blasting process. They work downward, blasting a twenty foot (6.1 m) wide vertical swath for the full ship height, lowering and extending the work platform using the work platform controls 114, as necessary, to facilitate access to the hull of the ship. This process takes approximately one shift.

One paint-spray worker then enters the work platform and (using conventional paint-spraying apparatus having a hose and nozzle 146 within the space 44 but a supply machine 148 located outside the space 44) paints the area just blasted by the abrasive-blasting workers operating the work platform in a like manner. This process takes approximately four hours.

Laborers then shovel/sweep up the spent abrasive on the dry-dock floor within the enclosure. This spent abrasive is placed into suitable containers for disposal and/or recycling as desired.

Figure 12:
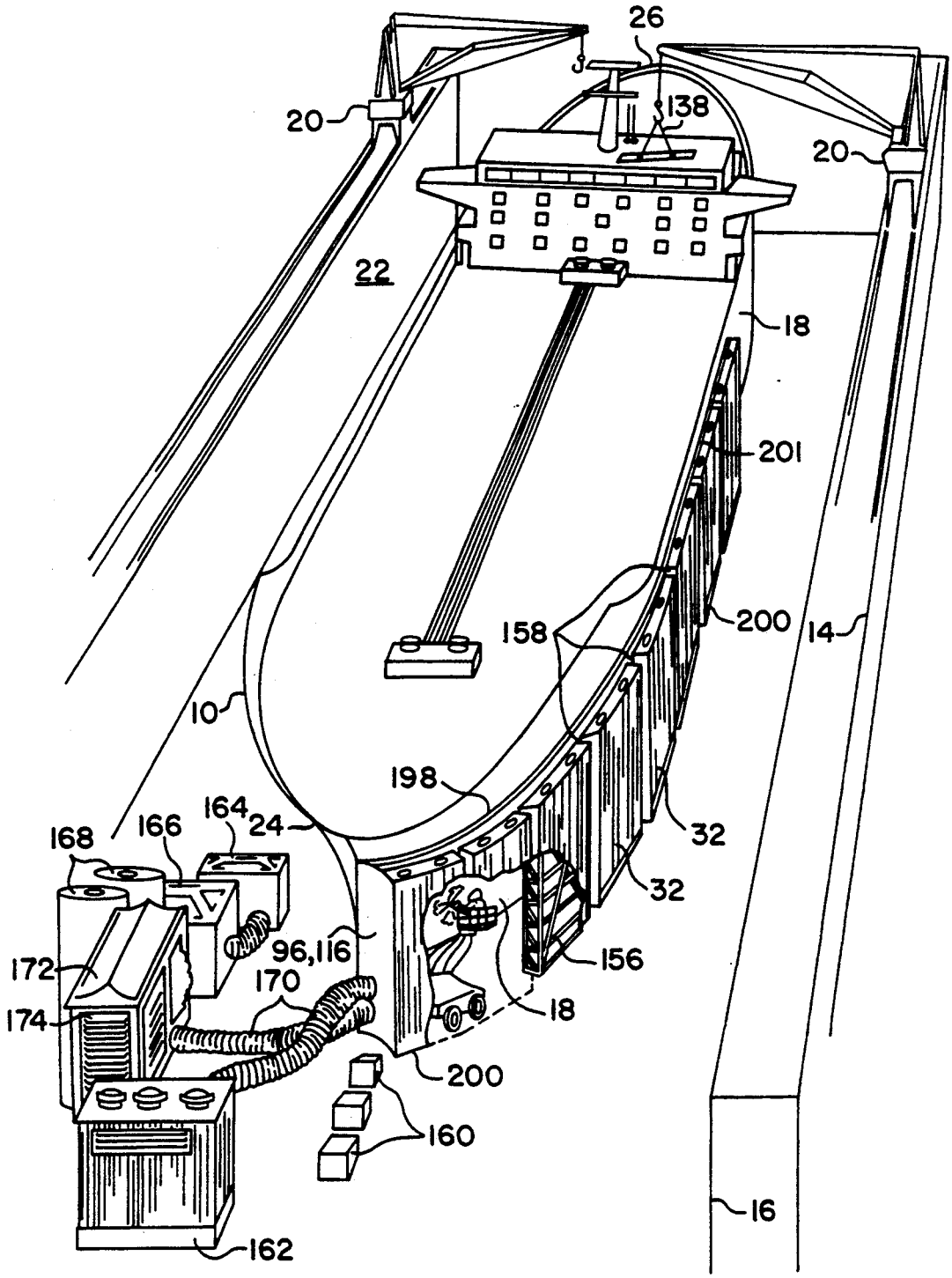
FIG. 12 is a pictorial view of use of composite enclosure assemblies mounted on a drydock floor (rather than on the floating barge of FIGS. 9 and 10) for use in conducting a coating operation from weather deck level down to keel level on a ship's hull, or for completing on the normally submerged portion of a ship's hull, a coating operation that had been begun and completed on the normally exposed portion of the ship's hull using the process and apparatus that is described with reference to FIGS. 9, 10 and 14.

Referring to FIG. 12, the preferred way of using the improved apparatus and method on a ship in drydock, a plurality, e.g., eight to twenty enclosed staging devices 32 laterally adjoining each other longitudinally of and spacedly confronting the portion of the hull which is fully accessible by the extended platform 40, preferably in combination with one to four compatible enclosures 156 without staging devices laterally adjoining each other and spacedly confronting bow and stern areas where there is extreme shape change are placed on the drydock floor 12 around, e.g., one-quarter of the perimeter of a ship 10 and individually attached at the top of the enclosure to the ship 10 using a temporary attachment 201. The top joints between the enclosures 42, 156 and the ship's hull 18 are sealed by an inflatable or other seal 198 as shown in FIG. 2. Inflatable seals 158 at one end of each individual enclosure unit along the top and outside are inflated to seal the joint between the shroud of each enclosure unit 42 or 156 and its adjacent enclosure unit 42 or 156. An adjustable non-porous curtain 94 with magnets 114 to attach to the ship's hull 18 is installed on the aft end of the aftermost enclosure unit 42 and the forward end of the forwardmost enclosure unit 156. When these shrouds are closed and a non-porous covering 122 placed on the side of keel blocks 160, one-quarter of the ship's hull area to be coated is thereby sealed in a large composite enclosure comprised of a plurality of the individual enclosure units 42, 156. Each shroud assembly 42 houses a tower 34 as has been described in relation to FIGS. 1–8. Some or all of the curtains 94 can be omitted at the sides between adjoining enclosed staging devices 32 for selectively isolating or merging respective portions of the space enclosed by the array of enclosure units 42, 156.

Portable storm water dams of gutter bars 200 with magnets 202 or other means of temporary attachment to the deck 12 of the drydock 14 are then placed around the perimeter of the enclosure and sealed by grouting, gasketing or other means 203.

Ventilation units 162, heating units 164, dehumidification units 166, abrasive blasting dust recovery units 168, paint overspray filter units and solvent evaporation VOC incineration units 172 are temporarily placed on the drydock floor, hooked up and connected to the large enclosure sealing off the ship's hull area to be coated by portable ventilation ducting 170. Any of the units 162, 164, 166, 168, 172 can be provided singly or in plurality, as needed. Each enclosed staging device 32 can be separately provided with such units, or two or more enclosed staging devices 32 can be served by any of such units in common. Likewise, ducting and service lines for such units can be provided separately for each enclosed staging device or unit, or in common for two or more enclosed staging devices or units. Ventilation units, heating units and dehumidification units, are operated during all coating phases. Abrasive blasting dust recovery units 168 are operated during abrasive blasting. Consumable or recyclable abrasives may be used based upon current balance of economic factors including abrasive cost, abrasive equipment capital cost and abrasive recycling cost. Paint overspray filter units and solvent evaporation VOC incineration units 172 are operated during paint application and curing periods.

Figure 11:
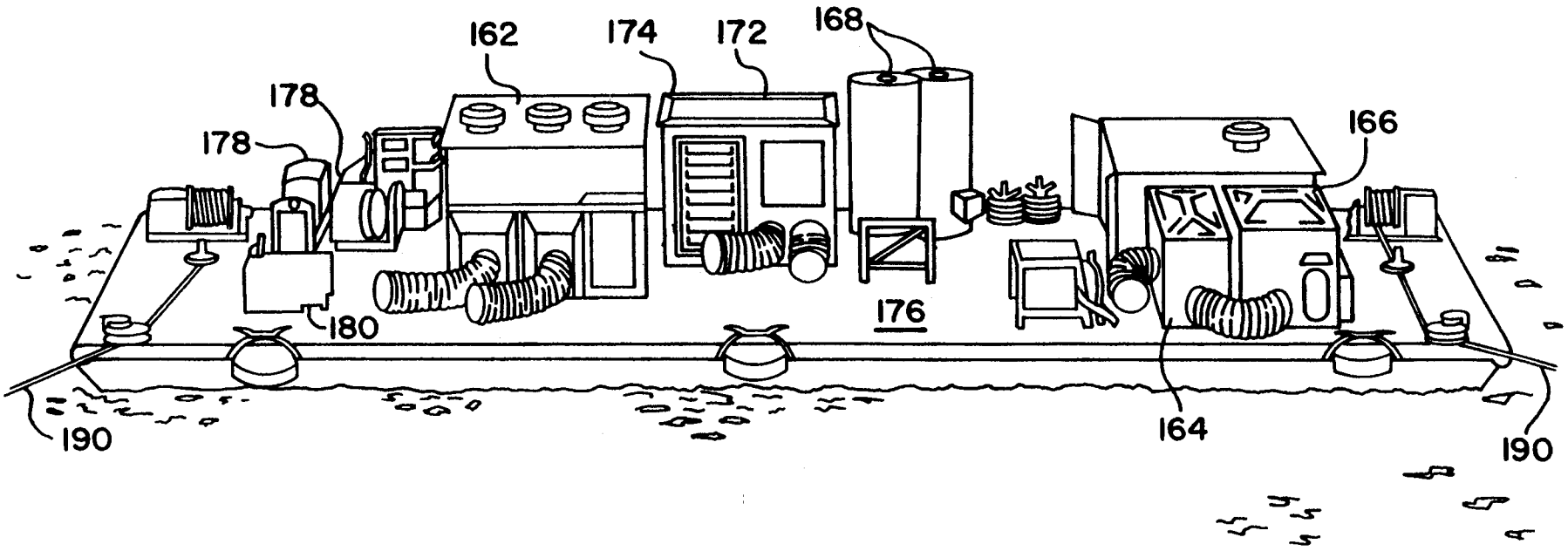
FIG. 11 is a pictorial view showing by itself the support barge of FIGS. 9, 13 and 14.
Figure 13:
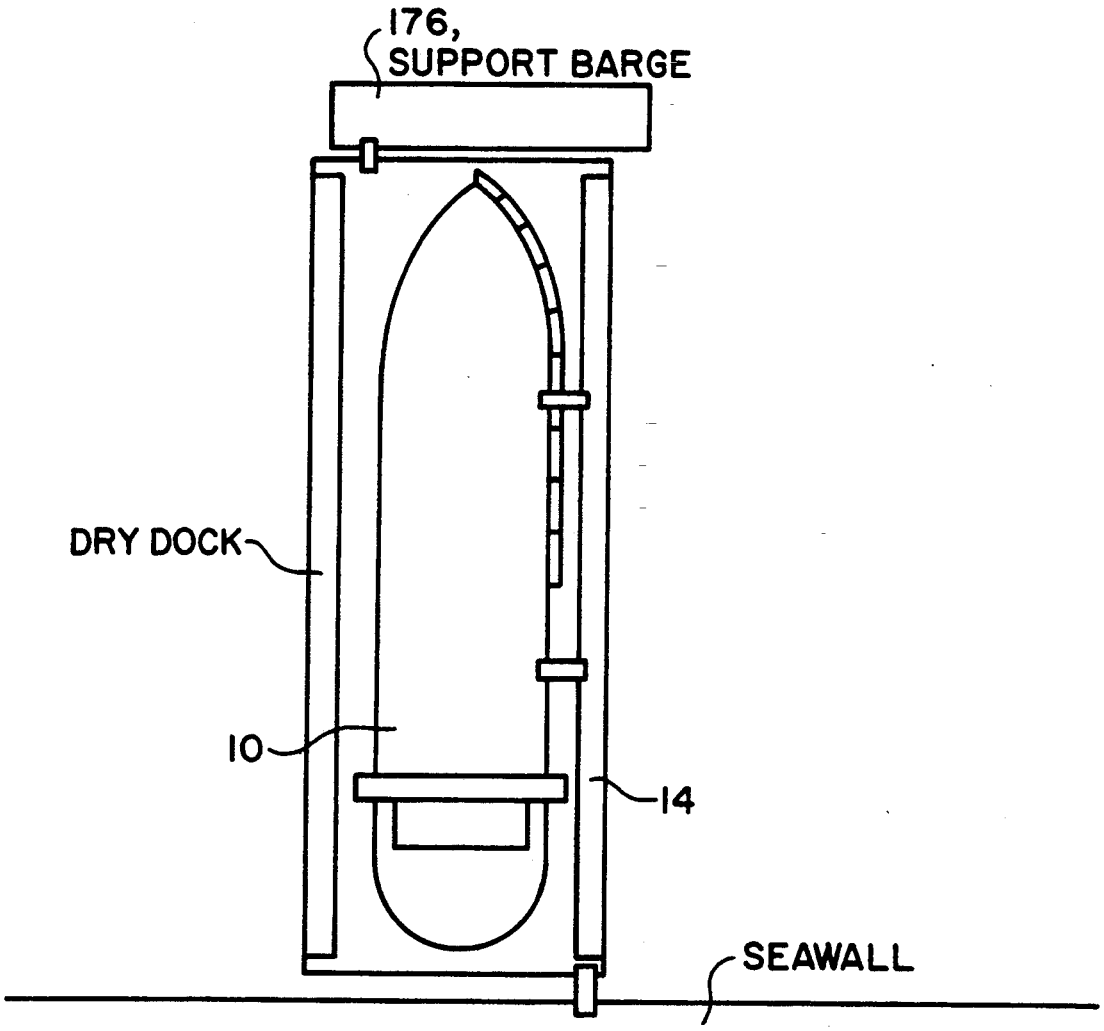
FIG. 13 is a schematic top plan view showing a practice of the coating operation which is described with reference to FIG. 12, also using the support barge which is described with reference to FIG. 11.

Preferably, if permitted by water access to an end of the drydock 14, FIG. 13, ventilation units 162, heating units 164, dehumidification units 166, abrasive dust collection units 168, paint overspray filter units 174 and solvent evaporation VOC incineration units 172 are permanently installed on a support barge 176 FIGS. 11 and 13, together with electrical generating equipment units 178 and fuel oil storage 180. This support barge 176 is then moored to the end of the drydock which corresponds to the end of the ship being coated. Air compressor, abrasive hoppers, abrasive pots, paint mixing machines and paint pots utilized in the coating process can also be located on the support barge, if that practice is judged to be appropriate and economical.

Figure 9:
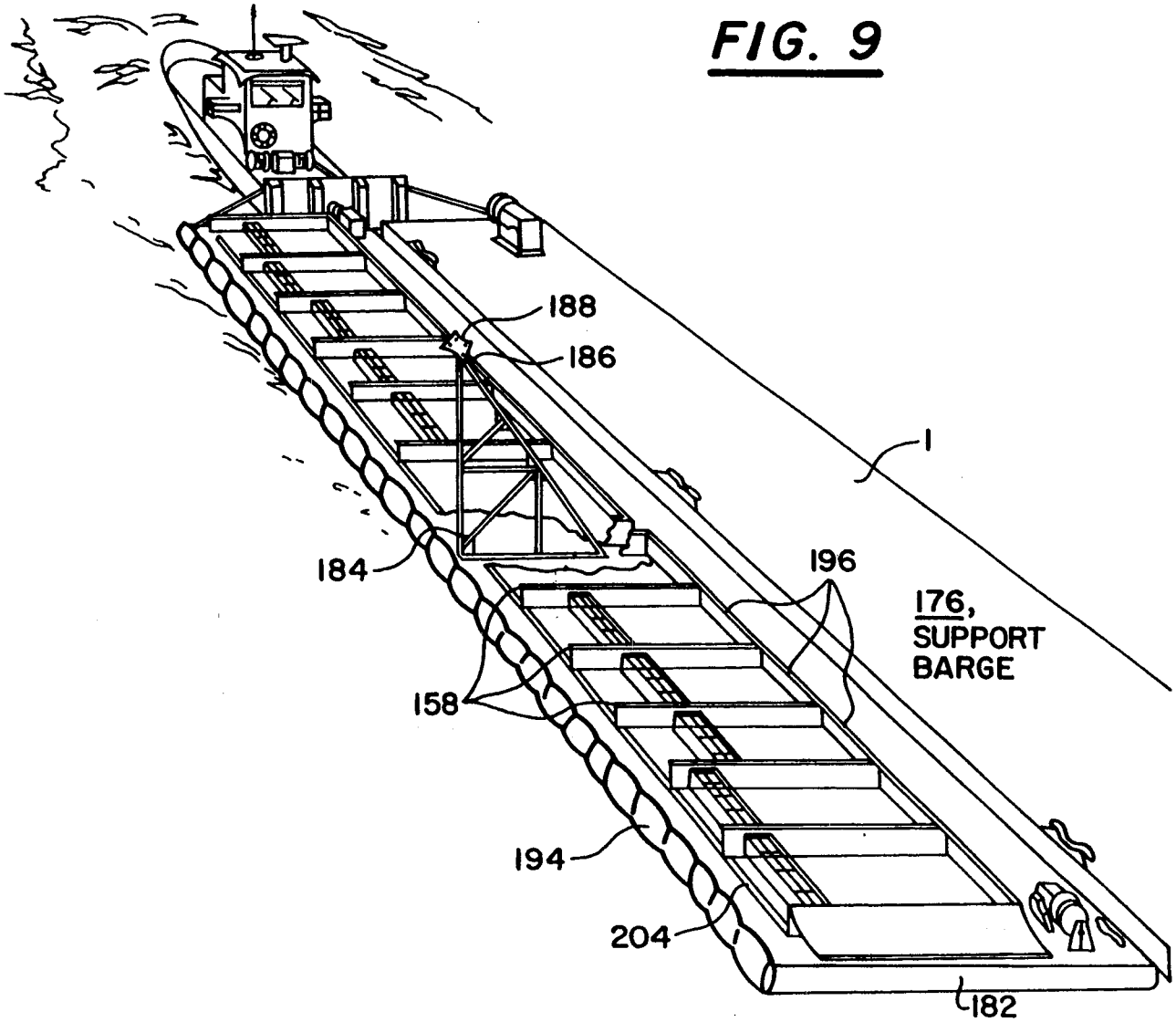
FIG. 9 is a pictorial view of a barge and support barge, with composite enclosure assemblies laid-over to horizontal positions on the barge deck, as the barge and support barge are being towed to position for conducting a coating operation on a floating ship (not shown in this figure)
Figure 10A:
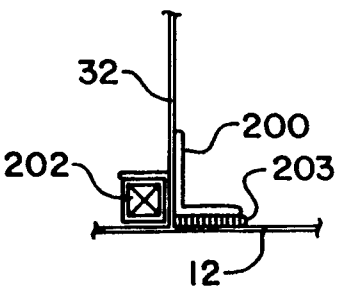
FIG. 10A is a larger scale transverse cross-sectional view of the region shown circled in FIG. 10.
Figure 10:
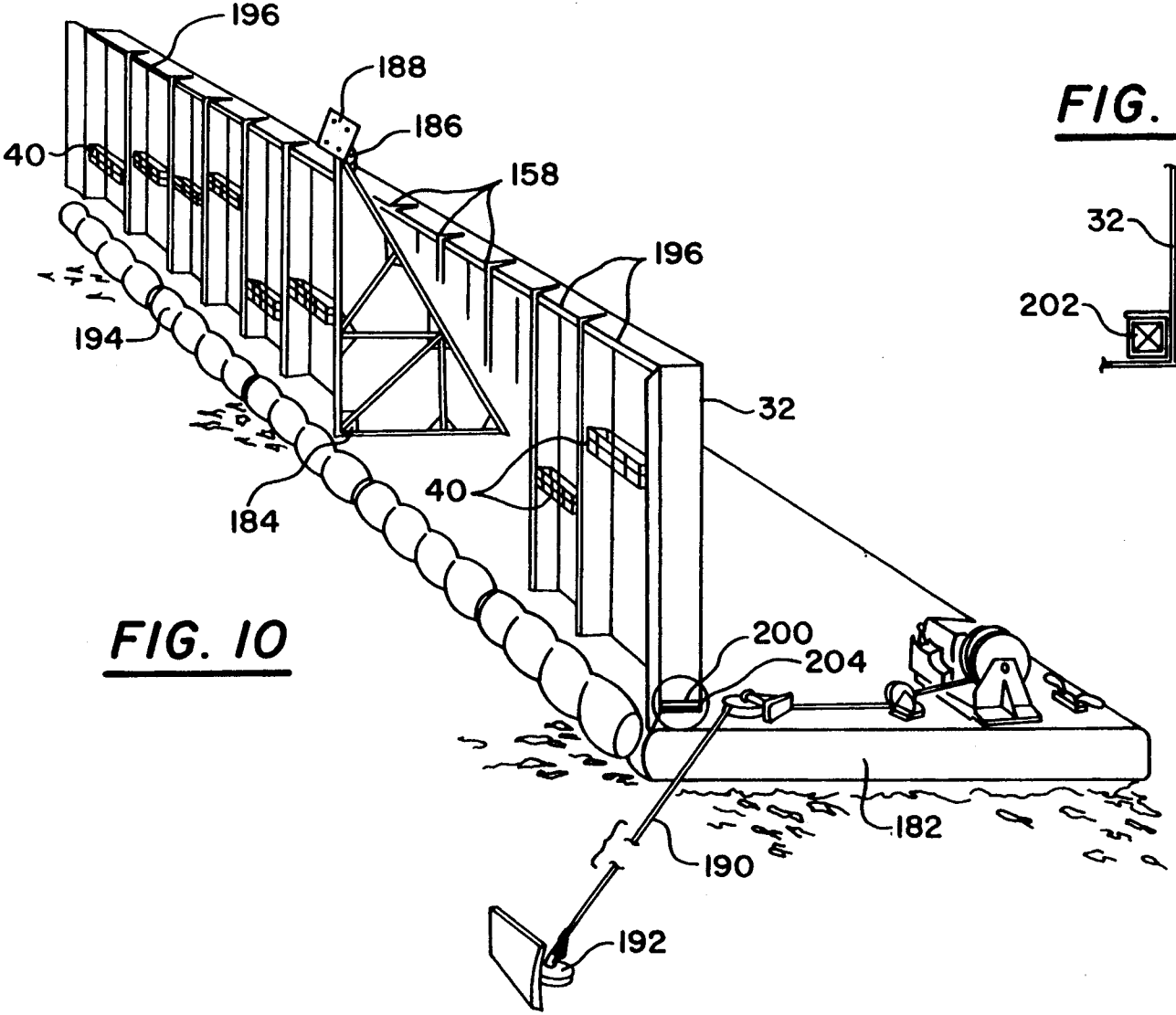
FIG. 10 is a pictorial view showing the barge of FIG. 9, with the enclosure assemblies erect for conducting a coating operation on a floating ship (not shown, but which would be at the left if shown in this figure), the support barge of FIG. 9 having been omitted from this figure.
Figure 14:
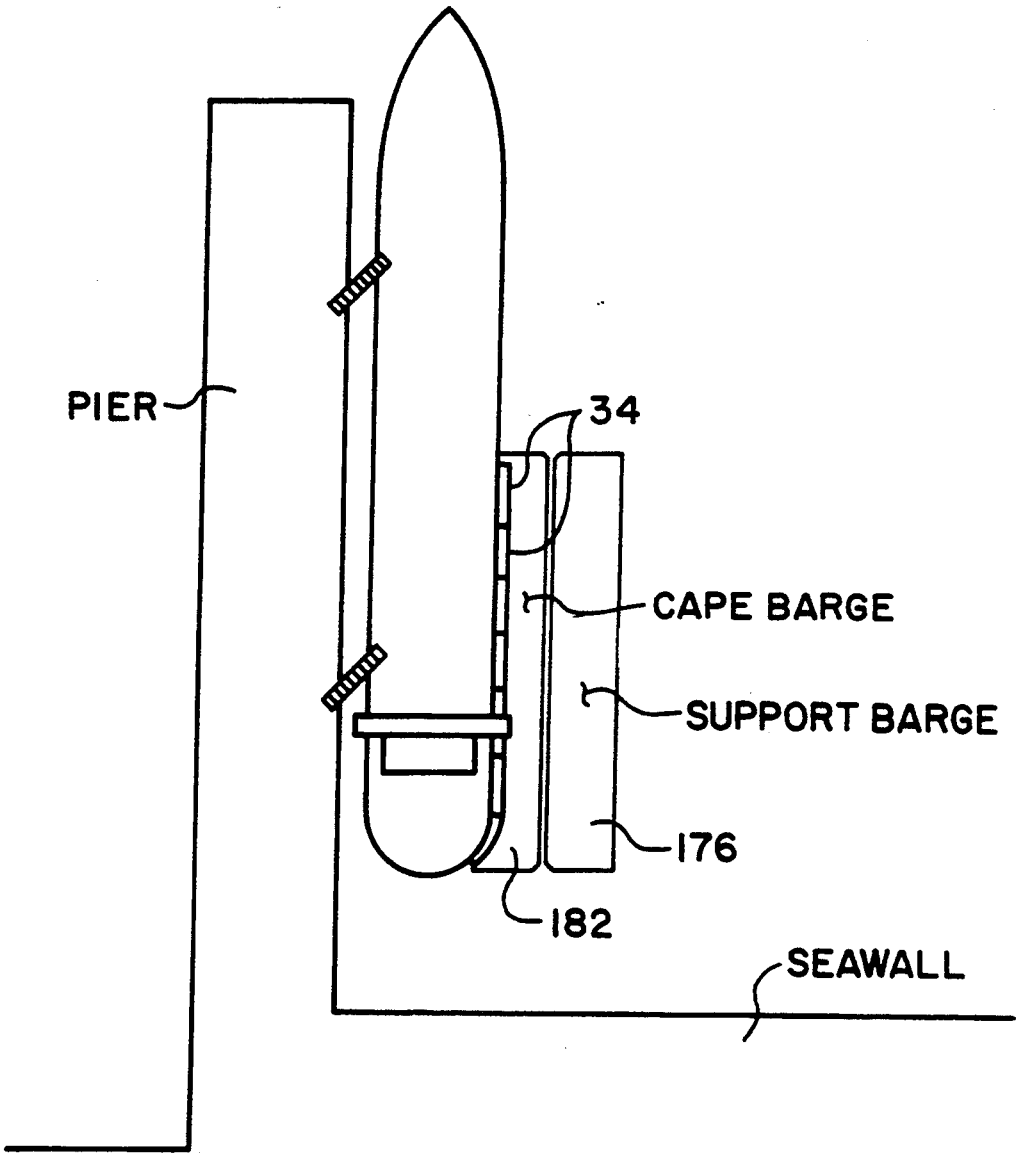
FIG. 14 is a schematic top plan view showing a practice of the coating operation which is described with reference to FIGS. 9 and 10, also using the support barge which described with reference to FIG. 11.

Referring to FIGS. 9, 10 and 14 (which show an alternative to the drydock deck-supported system of FIGS. 1, 2, 12 and 13), in the preferred way of using the improved method of coating hull areas above the waterline on ships afloat in the water, a plurality, e.g., eight to fifteen enclosed staging devices 32 are installed on a barge 182. The barge 182 has a vertical truss 184 comprised of segments which permit its height to be adjusted between twenty and eighty feet high. This truss is located at the longitudinal center line of the barge. At the top of the vertical truss 184 is located a connection 186 to the attachment device 188, the other end of which is attached to the ship's hull 18 at the highest practical point, by temporary welding, magnet, vacuum device or other means, but preferably by a mechanical connection to the ship's structure. At each end of the barge 182, at deck edge, are located winch-tautened attachment lines 190. Two attachment devices 192 are used to attach the ends of the lines 190 to the ship's hull 18, by temporary welding, magnet vacuum device or other means. Attachment devices 186 and 192 have six degrees of freedom, including change in relative draft of barge and ship upward and downward, plus rotation in both the horizontal and vertical directions. This type of attachment enables the large composite enclosure comprised of individual enclosure units 42 to remain sealed to the side of the ship without overstressing the attachment points, while absorbing loads caused by wind, waves, tide and variations in ship and barge drafts caused by changed loading.

The towers 34 of the staging devices (which towers are not shown but actually present in use of the FIG. 10 alternative) are pinned at 204 to the deck of the barge. The towers 34 are otherwise constructed and operated as has been disclosed in relation to FIGS. 1–8.

During transits of the barge 182 to and from the ship 10, the enclosed staging devices are laid horizontal, as shown in FIG. 9, with staging platforms 34 disposed in their lowered positions. After the barge 182 is attached to the ship 10 at the three attachment points 188 and 192, the enclosed staging devices 34 are raised into a vertical position using a floating derrick or winch with block and tackle attached to the ship. Inflatable seals 158 located between individual adjacent enclosed staging devices 34 are inflated. An inflatable seal at barge deck edge 194 between the barge 182 and the ship 10 is inflated. An inflatable seal 196 is installed in the gap between the top of the erect enclosed staging devices 34 and the ship and inflated. Impermeable shrouds 94 installed at the after end of the aftermost enclosed staging device 34 and forward end of the forwardmost enclosed staging device 34 are attached to the ship's hull using magnets 114. Portable storm water dams or gutter bars 200 with magnets 202 or other means of attachment either permanent or temporary to the deck of the coating barge 182 are placed around the perimeter of the enclosure and sealed at 203 by grouting, gasketing or other means. The ship's hull area to be coated is consequently fully enclosed and sealed off.

A support barge 176 is then moored to the enclosure barge 182, FIG. 14. Vent ducting, electrical power cabling, hoses as appropriate for the coating equipment (FIG. 11) are then connected from appropriate points on the support barge 176 to appropriate points in the enclosure and/or to coating equipment as has been described in relation to FIGS. 1–8 and 12. The coating process is then conducted using existing procedures, e.g., as further described in the above-mentioned U.S. patent application of Garland et al., with abrasive blast support equipment on the support barge energized during abrasive blasting, with paint application and curing support equipment aboard the support barge energized during paint application and curing.

It should now be apparent that the apparatus and method for performing external surface work on ships' hulls as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for servicing a generally vertical surface of substantial horizontal extent, comprising:

(a) selecting a series of horizontally adjoining increments of the surface, each having a given horizontal extent which is less than said substantial extent, and a given vertical extent which ranges downwards to adjacency with a generally horizontal platform;

(b) arranging a respective generally vertical tower on the platform in confronting relationship to, but spaced from each said increment of the surface, at least two said towers each having supported thereon a respective trolley which can be raised and lowered on the respective tower so as to place the respective trolley selectively in confronting relation with any selected horizontal strip of the respective said increment, and each said trolley having provided thereon a work platform cantilevered from the respective trolley towards the surface, on an arm structure which permits the respective work platform to be extended towards and retracted away from the surface;

(c) forming a series of horizontally adjoining curtain-enclosed space increments each of which includes a respective said tower and a respective said increment of said surface, with each said work platform thereby being disposed within a respective said space increment and all of said work platforms thereby being enclosed in common within a space composed of said space increments;

(d) while supporting at least one work-performing operator on each said work platform, causing each said operator to successively apply work to a plurality of said bands of respective ones of said increments of said surface confronted by a respective said work platform, and, in conjunction therewith, adjusting each said arm structure for adjusting the proximity of the respective said operators to the respective said increments of said surface.

2. The method of claim 1, wherein:

said surface is on a hull of a ship having a weather deck and a keel and each said operator is an abrasive blaster who successively abrasively blasts material from said hull.

3. The method of claim 2, wherein:

said abrasive blaster begins nearer the level of the weather deck of the ship and progressively works down to nearer the level of the keel of the ship.

4. The method of claim 3, wherein:

the hull slants or curves inwards, away from at least one said tower, in at least a portion thereof near the lower extent of the respective said increment, so that at least one said operator must progressively extend the respective said arm structure when progressing from band to band on each of several bands near the lower extent of the respective said increment.

5. The method of claim 4, further comprising:

(e) after steps (a)–(d) have been performed, step (d) is repeated by a painter who successively applies paint to said surface.

6. The method of claim 1, wherein:

said surface is on a hull of a ship, which curves more radically inwards, proceeding downwardly, adjacent at least one end of said hull than does said surface distally of ends of said hull;

in at least one said increment, which is disposed adjacent said one end of said hull, at least one respective said curtain-enclosed space encloses a movable operator supporting device which is supported directly on said generally horizontal platform; and while step (d) is being conducted, a respective work-performing operator is supported on each said movable operator supporting device and from said device applies work to a respective increment of said surface of said hull.

7. The method of claim 1, wherein:

said surface is on a hull of a ship supported on a floor in a drydock, and said generally horizontal platform is provided by said floor of said drydock.

8. The method of claim 1, wherein:

said surface is on a hull of a ship floating in a body of water, and said generally horizontal platform is provided by a deck of a barge floating in said body of water adjacent said hull.

9. The method of claim 5 further comprising:

continuously drawing air into said space, and out of said space into an air-cleaning device while conducting steps (d) and (e), in order to capture airborne abraded-off debris, paint overspray and volatile organic compounds for removal from air to be exhausted from said space.

10. The method of claim 1, wherein:

for each said space increment which encloses a respective said work platform at least one said operator is a human, and, while performing step (d), said human raises and lowers the respective said trolley on the respective said tower and at least one of extends and retracts the respective said arm structure for extending and retracting the respective said work platform.

11. The method of claim 10, wherein:

each said work platform has two laterally opposite ends, and at least one said human, after extending or before retracting the respective said arm structure, cocks the respective said platform so that one end of the respective said work platform is further than is the other end of the respective said platform, from the respective said tower.

12. The method of claim 1, wherein:

said surface is provided on a ferromagnetic substrate and at least portions of each said curtain are flexible and, as part of step (b), forward edges of flexible portions of each said curtain are adhered by magnets provided thereon, to said substrate.

13. The method of claim 12, wherein:

said substrate is a hull of a ship.

14. The method of claim 1, further comprising:

said surface is on a hull of a ship and, as part of step (c), forming a seal between said surface and an upper front edge of a respective top curtain forming each said curtain-enclosed space increment, between said surface and laterally adjacent top curtains of respective adjoining ones of said curtain-enclosed space increments, and between said surface and front edges of respective left and right side curtains forming said curtain-enclosed space.

15. The method of claim 14, wherein:

in at least two adjoining ones of said increments of said surface, said surface slopes downwardly and inwardly away from the respective said towers, and for at least said adjoining ones of said increments of said space, step (c) further includes forming the respective said curtain-enclosed space increments by providing respective front curtains having upper edges thereof sealed to said surface forwardly of the respective said tower, and having lower edges thereof disposed adjacent said generally horizontal platform.

16. The method of claim 15, further including:

while conducting step (d), damming, diverting and draining away rain water which impacts said surface and said curtains, so as to minimize contact of said rain water with debris generated within said curtain-enclosed spaces.

17. A device for use in applying work to a generally vertical surface of substantial horizontal extent, having a generally horizontal platform arranged therebeside, comprising:

a series of generally vertical towers each arranged to be supported on said platform in confronting relationship to, but spaced from a respective selected increment of said surface which has a given horizontal extent which is less than said substantial extent, and a given vertical extent which ranges downwards to adjacency with said platform, said increments being disposed laterally adjacent to one another;

at least two of said towers each having supported thereon a respective trolley which can be raised and lowered on the respective tower so as to place the respective trolley selectively in confronting relation with any selected horizontal strip of the respective said increment;

each said trolley having provided thereon a work platform cantilevered from the respective said trolley towards the surface, on an arm structure which permits the respective work platform to be extended towards and retracted away from the surface;

for each said tower, a respective curtain assembly supported on the respective said tower for forming a series of horizontally adjoining enclosed space increments each of which includes a respective said tower and a respective said increment of said surface, with each said work platform thereby being enclosed within a respective said space increment and all of said work platforms thereby being enclosed in common within a space composed of said space increments; and respective first power means operatively connected with each said trolley and respective second power means operatively connected with each said arm structure, respectively, for raising and lowering each said trolley and extending and retracting each said work platform.

18. The device of claim 17, further comprising:

means for continuously drawing air into each said space increment, and out of each said space increment into an air-cleaning device.

19. The device of claim 17, further comprising:

control means located on each said work platform for actuating the respective said first and second power means.

20. The device of claim 19, wherein:

said first and second power means respectively comprise for each said tower which has a respective said work platform, a respective hydraulically operated winch and a respective set of hydraulically operated extensible-retractable piston and cylinder assemblies.

21. The device of claim 20, wherein:

each said winch and each said set of assemblies have respective hydraulic systems powered by respective pump means that in turn are powered by electric motor means which are located outside said space.

22. The device of claim 19, wherein:

said platform has two laterally opposite ends; and said control means are constructed to be operable for cocking each said work platform only after such platform has been extended or retracted to a selected proximity to the respective said tower, so that either end of the respective said work platform can be positioned further from the respective said tower than the respective other of said ends thereof.

23. The device of claim 17, wherein:

at least portions of a plurality of said curtain assemblies, including ones at both ends of said series of towers are constituted by flexible side curtains having forward edges; and said forward edges are provided with magnet means for adjustably securing said curtains on said surface.

24. The device of claim 23, wherein:

each said curtain assembly having flexible side curtains further includes extensible-retractable stiffener means secured as a skeleton on said flexible side curtains and to the respective said tower; and said device further includes third power means operatively connected with said stiffener means for extending said forward edges of said flexible side curtains towards said surface and retracting said forward edges of said curtains away from surface.

25. The device of claim 17, further comprising:

each said tower having a plurality of adjustable jacking means which serve as respective feet for the respective said tower, whereby each said tower can be adjusted on said generally horizontal platform for greater verticality; and each said tower is provided with connector means arranged to be engaged by a crane for lifting the respective said tower, moving the respective said tower into confronting relation with a different increment of said surface, and at such a place, setting said tower down onto said generally horizontal platform.

26. The device of claim 17, further including:

an abrasive blasting machine located outside said space, and having an output hose means extending into each said space increment to serve a nozzle disposed within each respective said space increment.

27. The device of claim 17, further including:

a paint spraying machine located outside said space, and having an output hose means extending into each said space increment to serve a nozzle disposed within each respective said space increment.

28. The device of claim 17, further including:

a drydock having a floor, said generally horizontal platform being provided by said floor.

29. The device of claim 17, further including:

a floating barge having a deck, said generally horizontal platform being provided by said deck.

30. The device of claim 17, further including:

a floating support barge;

at least one of a ventilating means, a heating means, a dehumidification means, an abrasive blasting machine, a paint spraying machine, a paint overspray filtration machine and a solvent evaporation volatile organic chemical incinerator supported on said floating support barge and effectively connected by respective supply line means to respective of said space increments.

31. The device of claim 17, further including:

means for forming a seal between said surface and an upper front edge of a respective top curtain forming each said space increment, between said surface and laterally adjacent top curtains of respective adjoining ones of said space increments, and between said surface and front edges of respective left and right side curtains forming said space.

32. The device of claim 31, further including:

respective front curtains having upper edges thereof sealed to said surface forwardly of respective said towers and having lower edges thereof arranged to be disposed adjacent said generally horizontal platform.

33. The device of claim 17, further comprising:

means supported on said generally horizontal platform for damming, diverting and draining away rain water which impacts said surface and said curtain assemblies, so as to minimize contact of said rainwater with debris generated within said space.

* * * * *